US012650024B1

(12) United States Patent
Wang

(10) Patent No.: US 12,650,024 B1
(45) Date of Patent: Jun. 9, 2026

(54) SWIMMING POOL COVER

(71) Applicant: Yuan Wang, Dongguan (CN)

(72) Inventor: Yuan Wang, Dongguan (CN)

( * ) Notice: Subject to any disclaimer, the term of this patent is extended or adjusted under 35 U.S.C. 154(b) by 0 days.

(21) Appl. No.: 19/403,501

(22) Filed: Nov. 28, 2025

(30) Foreign Application Priority Data

Oct. 28, 2025 (CN) ..... 202522274298.1

(51) Int. Cl.
*E04H 4/10* (2006.01)

(52) U.S. Cl.
CPC ..... *E04H 4/10* (2013.01)

(58) Field of Classification Search
CPC ... E04H 4/10; E04H 4/06; B60P 7/083; B60P 7/70823; B60P 7/08; B60P 7/0846
USPC ..... 4/498
See application file for complete search history.

(56) References Cited

U.S. PATENT DOCUMENTS 5,826,283 A * 10/1998 Edwards ..... E04H 4/10 4/503
6,286,157 B1 * 9/2001 Baumann ..... E04H 4/103 4/503
6,682,053 B1 * 1/2004 Chou ..... B60P 7/083 254/218
9,021,625 B1 * 5/2015 Vagner, Jr. ..... E04H 4/108 4/498
10,966,372 B1 * 4/2021 Anspach ..... B65B 27/125
12,241,272 B1 * 3/2025 Li ..... E04H 4/10
2009/0283729 A1 * 11/2009 Carlson ..... B60P 7/083 254/218
2016/0347233 A1 * 12/2016 Kingery ..... B60P 7/0846
2020/0238888 A1 * 7/2020 Zhou ..... B60P 7/083
2023/0249603 A1 * 8/2023 Stiles ..... B60P 7/083 24/68 CD

* cited by examiner

*Primary Examiner* — Huyen D Le
(74) *Attorney, Agent, or Firm* — Maier & Maier, PLLC

(57) ABSTRACT

A swimming pool cover is provided, including a flexible covering layer used to enclose and cover a pool; a tightening strap is disposed around the flexible covering layer; and a tensioning device, which includes a retaining support and a tensioning support pivotally connected, and a first elastic limiting member is disposed on the retaining support, a second elastic limiting member is disposed on the tensioning support; a winding shaft portion extends through a pivot connection between the retaining support and the tensioning support; a one-way ratchet is disposed on the winding shaft portion. By rotating the tensioning support, the winding shaft portion has a locked state and a winding state. The tightening strap is wound by rotation of the winding shaft portion, thereby tightening the covering layer around an outer side wall of the pool, overcoming the excessive manual force needed in conventional V-shaped arm mechanisms.

10 Claims, 5 Drawing Sheets

SWIMMING POOL COVER

CROSS-REFERENCE TO RELATED APPLICATION(S)

The present application claims priority to Chinese Patent Application No. 202522274298.1, filed on Oct. 28, 2025, the content of all of which is incorporated herein by reference.

FIELD

The present application relates to the technical field of pool covers, in particular to a swimming pool cover.

BACKGROUND

The existing outdoor standalone swimming pools are exposed to the open air and are prone to accumulating dust, fallen leaves, insects, and other debris, which can cause water contamination. Therefore, pool covers made of lightweight materials are commonly available on the market to cover the swimming pool when the swimming pool is not in use. In actual use, since the fabric of the pool cover is relatively light, it can easily be lifted or even blown away by strong winds.

Currently, various fasteners are used on the market to fasten the pool cover to the pool, preventing the cover from coming off. For example, the utility model patent with publication number CN223151739U, titled "A Swimming Pool Cover", discloses a fastening mechanism that operates through the cooperation of a rotating device and a ratchet. The rotating device includes a V-shaped first rotating arm and a second rotating arm. During the process of tightening the rope, the V-shaped rotating arm is twisted to rotate and wind up the rope. However, in the final stage of tightening, when the user twists the rotating arm by hand, a considerable amount of finger force is required to achieve full tightening, which makes the operation laborious and inconvenient.

Therefore, the prior art still requires improvement and development.

SUMMARY

In view of the deficiencies in the prior art described above, an objective of the present application is to provide a swimming pool cover, aiming to solve the problem in the prior art that, during the tightening process, the V-shaped rotating arm must be twisted by fingers, making the operation laborious and inconvenient.

To achieve the above purpose, a technical solution adopted in the present application is as follows:

The present application provides a swimming pool cover, including a flexible covering layer, the flexible covering layer is configured to enclose and cover a swimming pool;

a tightening strap, the tightening strap is disposed around the flexible covering layer;

a tensioning device, the tensioning device includes:

a retaining support and a tensioning support pivotally connected to each other, a first elastic limiting member is disposed on the retaining support, and a second elastic limiting member is disposed on the tensioning support;

a winding shaft portion, the winding shaft portion extends through a pivot connection between the retaining support and the tensioning support; and a one-way ratchet, the one-way ratchet is disposed on the winding shaft portion, the tightening strap is wound around the winding shaft portion;

the winding shaft portion has a locked state and a winding state by rotating the tensioning support;

in the locked state, the tensioning support is pulled to rotate toward the retaining support, the second elastic limiting member disengages from the one-way ratchet, and the one-way ratchet is locked by the first elastic limiting member to prevent rotation of the winding shaft portion;

in the winding state, the tensioning support is pulled to rotate away from the retaining support, the first elastic limiting member disengages from the one-way ratchet, and the one-way ratchet is locked by the second elastic limiting member and rotates with the tensioning support, causing the winding shaft portion to rotate;

the tightening strap is wound by the rotation of the winding shaft portion to tighten the flexible covering layer around an outer side wall of the pool.

Optionally, one end of the tightening strap is fixed to the retaining support, and an other end of the tightening strap is wound around the winding shaft portion, the tightening strap is disposed over the flexible covering layer and extends circumferentially around the outer side wall of the pool;

the winding shaft portion is driven by a reciprocating swing of the tensioning support to rotate unidirectionally, thereby winding up the tightening strap.

Optionally, the winding shaft portion includes: a first arcuate shaft and a second arcuate shaft, the first arcuate shaft and the second arcuate shaft are both disposed on the one-way ratchet, and the retaining support and the tensioning support are rotatably sleeved on the first arcuate shaft and the second arcuate shaft;

the first arcuate shaft and the second arcuate shaft are spaced apart to form a threading cavity between the first arcuate shaft and the second arcuate shaft.

Optionally, the tensioning support includes: a tensioning bracket, the tensioning bracket is rotatably disposed on the winding shaft portion;

a rubber-coated handle, the rubber-coated handle is fixedly disposed on the tensioning bracket at one end distal from the winding shaft.

Optionally, the rubber-coated handle includes: a sleeve portion, the sleeve portion is sleeved over a top of the tensioning bracket;

a cylindrical top portion, the cylindrical top portion is disposed at a top of the sleeve portion, and an outer diameter of the cylindrical top portion is greater than a thickness of the sleeve portion;

two obtuse angle openings are formed on opposite sides in a width direction of the sleeve portion, and reinforcing ribs are fixedly disposed within the obtuse angle openings;

a second convex-concave anti-slip portion is disposed on an outer surface of the cylindrical top portion.

Optionally, the second elastic limiting member includes: a second locking block, the second locking block is slidably disposed within second guide slots of the tensioning bracket;

a second spring, the second spring is connected respectively to the second locking block and the tensioning bracket, and applies elastic force to the second locking block, causing the second locking block to engage with teeth of the one-way ratchet;

a rubber-coated grip, the rubber-coated grip is disposed on the second locking block, and the rubber-coated grip forms a handle portion, with the handle portion facing outward an outer side of the tensioning bracket.

Optionally, the rubber-coated handle includes: a rubber coating layer, the rubber coating layer encases the second locking block;

a protruding rubber block, the protruding rubber block is connected to a top of the rubber coating layer, with the handle portion having a step shape being formed between the protruding rubber block and the rubber coating layer;

a cushioning layer, the cushioning layer is disposed on a surface of the handle portion;

a first convex-concave anti-slip portion is disposed on the surface of the handle portion or on a surface of the cushioning layer.

Optionally, the tensioning support includes: tensioning side plates located on two widthwise sides of the tensioning support, and a second support plate connecting the tensioning side plates;

the second support plate is disposed adjacent to tops of the tensioning side plates, forming a cavity on a side of the second support plate facing the winding shaft portion, and the rubber-coated handle is positioned within the cavity.

Optionally, the retaining support includes: retaining side plates located on two widthwise sides of the retaining support, and a first support plate connecting the retaining side plates; the retaining side plates and the first support plate form a first inner cavity, and the first elastic limiting member is disposed within the first inner cavity;

a shaft rod is fixedly disposed at one end of the retaining side plates, and the one end of the tightening strap is connected to the shaft rod.

Optionally, the flexible covering layer includes a central portion and a peripheral portion, the peripheral portion is connected to the central portion, the central portion is configured to cover a pool opening, and the peripheral portion is configured to enclose the outer side wall of the pool;

a lug is disposed on the peripheral portion, the lug forms a rope passage, and the tightening strap passes through the rope passage;

the lug further forms a mounting opening, the mounting opening is located below the rope passage, and the mounting opening is configured for connection to a weight or a ground stake;

a cover shroud is further disposed on the peripheral portion, and the cover shroud is attached to the peripheral portion via a hook-and-loop fastener, and the cover shroud is configured to cover the tensioning device.

The beneficial effects of the swimming pool cover provided by the present application are at least as follows: after the flexible covering layer is fitted around the outer side wall of the pool, the tightening strap is connected to the retaining support and the winding shaft portion, thereby forming a loop structure that can be fitted circumferentially around the flexible covering layer. Through the cooperative engagement between the first elastic limiting member and the second elastic limiting member with ratchet teeth of the one-way ratchet, a unidirectional rotation positioning function of the one-way ratchet is realized. The entire palm can hold a distal end of the tensioning support for pulling and pushing, thereby causing rotation of the tensioning support. When the tensioning support rotates away from the retaining support, the winding shaft portion enters a winding state. In this state, the first elastic limiting member moves along arcuate guide surfaces of the ratchet teeth and disengages from the one-way ratchet, while retaining surfaces of the ratchet teeth is held in position by the second elastic limiting member. Consequently, the one-way ratchet rotates together with the tensioning support, driving the winding shaft portion to rotate, which in turn winds the one end of the tightening strap onto the winding shaft portion, thereby tightening the entire tightening strap. When the tensioning support rotates toward the retaining support (during return stroke), the winding shaft portion enters a locked state. In this state, the second elastic limiting member moves along the arcuate guide surfaces of the ratchet teeth and disengages from the one-way ratchet, while the retaining surfaces of the ratchet teeth is held in position by the first elastic limiting member, thereby locking the one-way ratchet and the retaining support together. As a result, the winding shaft portion remains stationary. Therefore, by repeatedly pushing and pulling the tensioning support, the tightening device enables intermittent rotation of the winding shaft portion for continuous winding, thereby achieving locking of the tightening strap and fastening the covering layer to the outer side wall of the pool. During use, the user applies force by gripping the distal end of the tensioning support, and the tightening device realizes unidirectional tightening via a mechanical ratchet structure, reducing risks of loosening caused by swinging under strong wind. In terms of operational convenience, compared to traditional rope-tying methods, this structure enables quick fixation through simple operation, with an efficiency improvement of over tenfold. Furthermore, the pushing and pulling action performed by the palm allows for easier force application, reducing manual effort by approximately 50% and enhancing convenience.

BRIEF DESCRIPTION OF THE DRAWINGS

To more clearly illustrate technical solutions in embodiments of the present application or in the prior art, the accompanying drawings required for describing the embodiments or the prior art will be briefly introduced below. It is obvious that the accompanying drawings in the following description represent only certain embodiments of the present application. Those of ordinary skill in the art can obtain additional accompanying drawings based on the drawings without inventive effort.

DETAILED DESCRIPTION OF EMBODIMENTS

Figure 1:
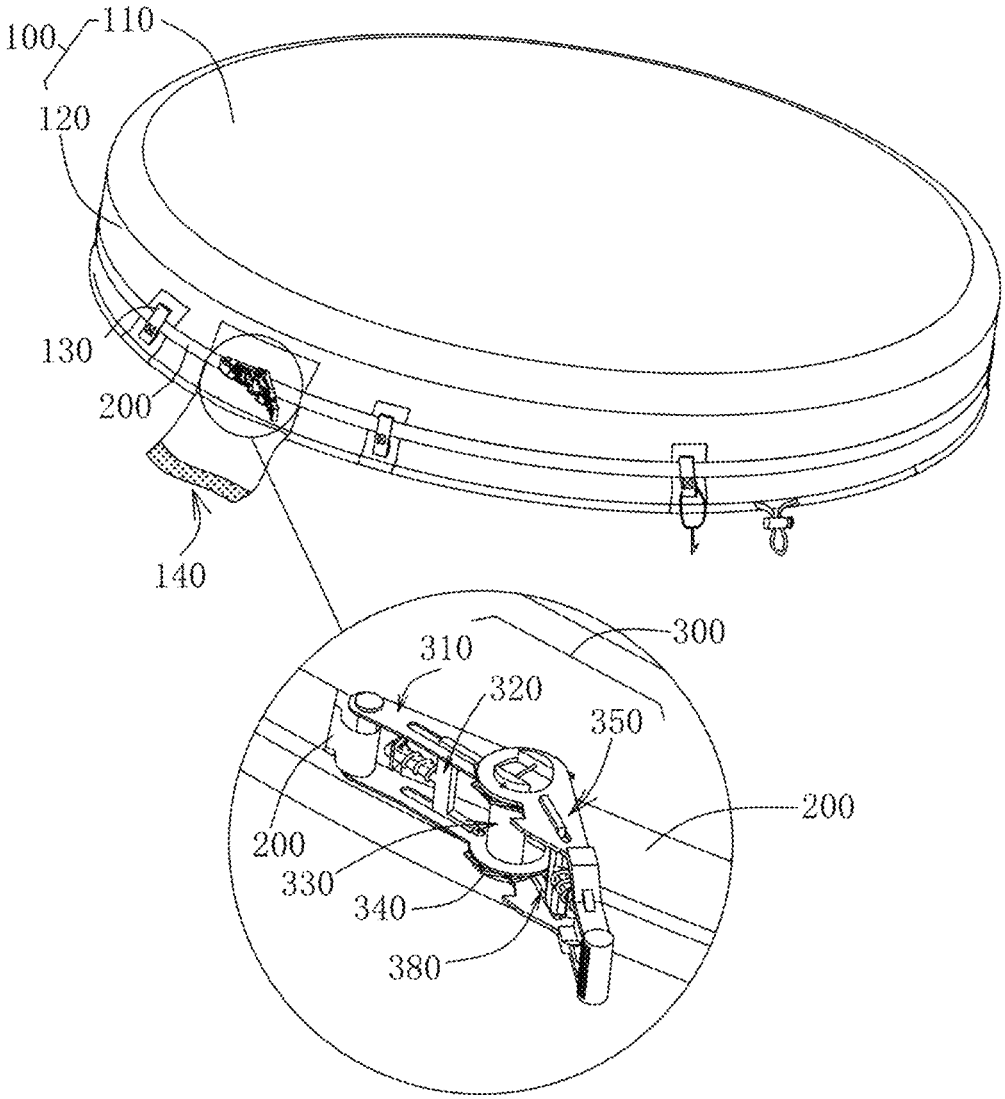
FIG. 1 is a structural schematic diagram of a swimming pool cover provided in an embodiment of the present application.

To make the technical problems to be solved, the technical solutions, and the beneficial effects of the present application clearer, the following description is provided in further detail in conjunction with the accompanying drawings and embodiments. It should be understood that the specific embodiments described herein are merely for explaining the present application only, and are not intended to limit the present application.

It should be noted that the reference lines with arrows indicate non-solid areas such as holes or grooves, or superordinate features that are not specific physical features, or a specific direction. Reference lines without arrows indicate solid features or specific subordinate physical features.

When a component is described as being "located on/positioned on" or "disposed on/provided with" another component, it may be directly or indirectly located on that other component. When a component is described as being "connected to/connected with" another component, it may be directly or indirectly connected to that other component. The terms "upper", "lower", "left", "right", "front", "rear", "vertical", "horizontal", "top", "bottom", "inner", and "outer" indicating orientation or position are based on the orientation or position shown in the drawings and are used merely for convenience of description, and should not be construed as limiting the present technical solution. The terms "first" and "second" are used solely for ease of description and should not be understood as indicating or implying relative importance or suggesting a specific quantity of technical features. The term "multiple/a plurality of" mean two or more, unless otherwise explicitly and specifically defined.

Figure 2:
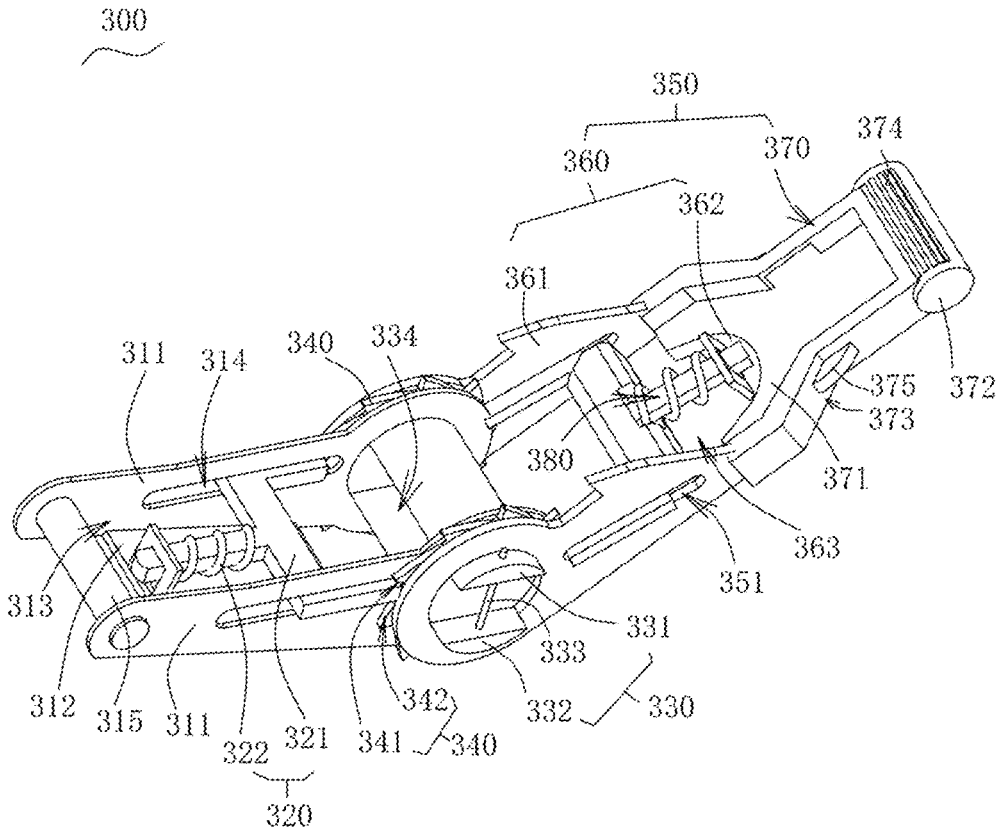
FIG. 2 is a structural schematic diagram of a tightening device of the swimming pool cover provided in an embodiment of the present application.

As shown in FIG. 1 and FIG. 2, the present embodiment provides a swimming pool cover for covering the pool when a swimming pool is not in use. The swimming pool cover mainly includes a flexible covering layer 100, a tightening strap 200, and a tightening device 300. The flexible covering layer 100 is used to enclose and cover the swimming pool. The flexible covering layer 100 includes a central portion 110 and a peripheral portion 120. The peripheral portion 120 is connected to the central portion 110. The central portion 110 serves to cover an opening of the swimming pool, and the peripheral portion 120 serves to enclose an outer side wall of the swimming pool. The tightening strap 200 is sleeved on the peripheral portion 120 of the flexible covering layer 100 to bind and secure the peripheral portion 120 to the outer side wall of the swimming pool. The peripheral portion 120 is provided with a lug 130. A plurality of lugs 130 may be provided, spaced along a circumference of the peripheral portion 120. Each lug 130 is provided with a rope passage 131. The tightening strap 200 passes through the rope passage 131, forming a loop around the peripheral portion 120. The tightening strap 200 is connected to the tightening device 300 to be wound and locked. The lug 130 may also be provided as a single continuous lug extending around an entire circumference of the peripheral portion 120, which also enables connection with the tightening strap 200.

As shown in FIG. 1 and FIG. 2, the tightening device 300 of the present embodiment mainly includes a retaining support 310 and a tensioning support 350 hinged together, a winding shaft portion 330, and a one-way ratchet 340. A first elastic limiting member 320 is provided on the retaining support 310. A second elastic limiting member 380 is provided on the tensioning support 350. The winding shaft portion 330 is provided at a pivot connection between the retaining support 310 and the tensioning support 350. During use, one end of the tightening strap 200 is connected to the retaining support 310 as fixed on the peripheral portion 120, and the tensioning support 350 rotates back and forth around a central axis of the winding shaft portion 330. The one-way ratchet 340 is fixed on the winding shaft portion 330. An other end of the tightening strap 200 is wound around the winding shaft portion 330, so that the tightening strap 200 is fitted on the flexible covering layer 100 and extends around the outer side wall of the swimming pool. By rotating the tensioning support 350, the winding shaft portion 330 has a locked state and a winding state. Under the back-and-forth swinging of the tensioning support 350, the winding shaft portion 330 cyclically undergoes the locked state and the winding state, thereby causing the winding shaft portion 330 to perform intermittent unidirectional rotation, and thereby gradually winding up an other end of the tightening strap 200. In the locked state, the tensioning support 350 is pulled to rotate toward the retaining support 310. The second elastic limiting member 380 disengages from the one-way ratchet 340, and the one-way ratchet 340 is locked by the first elastic limiting member 320, preventing rotation of the winding shaft portion 330. In the winding state, the tensioning support 350 is pulled to rotate away from the retaining support 310. The first elastic limiting member 320 disengages from the one-way ratchet 340, and the one-way ratchet 340 is locked by the second elastic limiting member 380 and rotates with the tensioning support 350, causing the winding shaft portion to rotate. The tightening strap 200 is wound by rotation of the winding shaft portion 330, thereby tightening the flexible covering layer 100 around the outer side wall of the swimming pool. After the flexible covering layer 100 is fitted on the outer side wall of the swimming pool, the tightening strap 200 is connected to the retaining support 310 and the winding shaft portion 330, a loop structure that encircles the peripheral direction of the flexible covering layer 100. The first elastic limiting member 320 and the second elastic limiting member 380 movably engage with ratchet teeth of the one-way ratchet 340, realizing unidirectional rotation positioning of the one-way ratchet 340. An entire palm can hold a distal end of the tensioning support 350 for pulling and pushing to rotate the tensioning support 350. When the tensioning support 350 rotates away from the retaining support 310, the winding shaft portion 330 enters the winding state. In this state, the first elastic limiting member 320 moves along arcuate guide surfaces 342 of the ratchet teeth so as to disengage from the one-way ratchet 340. Retaining surfaces 341 of the ratchet teeth of the one-way ratchet 340 is locked is locked by the second elastic limiting member 380, causing the one-way ratchet 340 to rotate together with the tensioning support 350, driving the winding shaft portion 330 to rotate, winding the one end of the tightening strap 200 to be wound onto the winding shaft portion 330, tightening the entire tightening strap 200. When the tensioning support 350 rotates toward the retaining support 310 (return stroke), the winding shaft portion 330 is in the locked state. In this state, the second elastic limiting member 380 moves along the arcuate guide surfaces 342 of the ratchet teeth to disengage from the one-way ratchet 340. The retaining surfaces 341 of the ratchet teeth of the one-way ratchet 340 is locked by the first elastic limiting member 320, thereby locking the one-way ratchet 340 and the retaining support 310 together, preventing rotation of the winding shaft portion 330. Therefore, using the tightening device 300 to pull and push the tensioning support 350 enables intermittent rotation of the winding shaft portion 330 for continuous winding, achieving locking of the tightening strap 200 and tightening of the flexible covering layer 100 on the outer side wall of the swimming pool. During use, force is applied by gripping the distal end of the tensioning support 350. The tightening device 300 achieves unidirectional tightening through mechanical ratchet structure, reducing risks of loosening due to swinging under strong wind. The present application enables rapid fixation through simple operation. Compared to traditional rope-tying methods, the operational convenience is significantly improved, with an efficiency increase of over tenfold. Furthermore, pushing and pulling action performed using the palm allows for more effortless force application, reducing manual effort by approximately 50% and resulting in more convenient overall operation.

For convenience of structural description, an axial direction of the winding shaft portion 330 in the tightening device 300 is defined as a width direction, and the width direction serves as a left-right direction for structural description. During use of the tightening device 300, one side of the tensioning support 350 facing toward the retaining support 310 is defined as an inner side, while one side facing away from the retaining support 310 is defined as an outer side.

Figure 3:
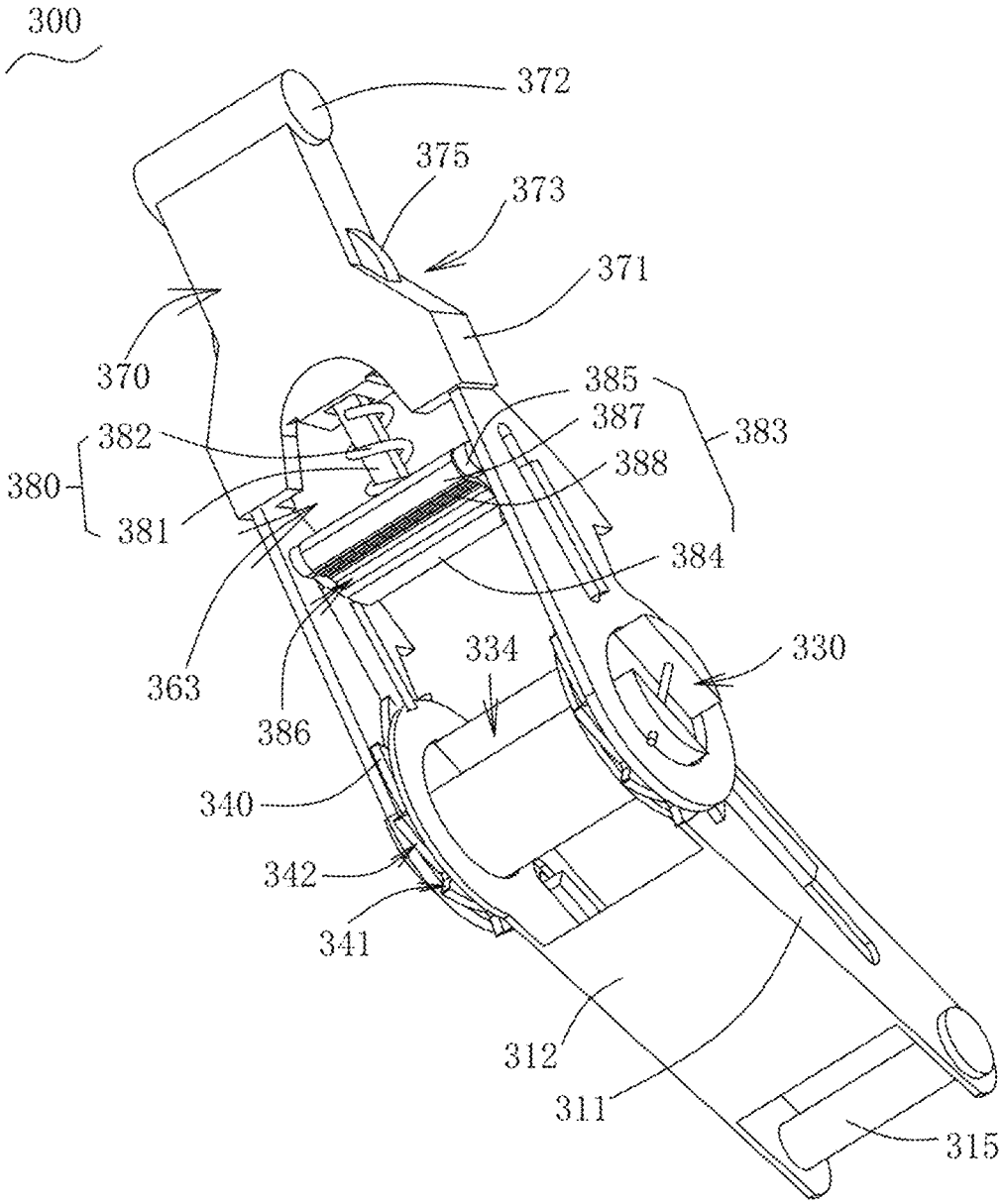
FIG. 3 is a structural schematic diagram of the tightening device of the swimming pool cover provided in an embodiment of the present application, shown from another perspective.

As shown in FIG. 2 and FIG. 3, the retaining support 310 in the present embodiment includes retaining side plates 311 spaced apart on left and right sides of the retaining support 310, and a first support plate 312 connecting the retaining side plates 311 on the left and right sides of the retaining support 310. The first support plate 312 is located at an edge of the retaining side plates 311 facing the outer side, such that the retaining side plates 311 on the left and right sides of the retaining support 310 together with the first support plate 312 enclose a first inner cavity 313. The first elastic limiting member 320 is provided within the first inner cavity 313. The first elastic limiting member 320 includes a first locking block 321 and a first spring 322. The first locking block 321 is slidably arranged in first guide slots 314 of the retaining side plates 311 on the left and rights of the retaining support 310. The first spring 322 connects the first locking block 321 and the first support plate 312. The first spring 322 applies an elastic force to the first locking block 321, causing the first locking block 321 to press against the ratchet teeth of the one-way ratchet 340. In the locked state, the first locking block 321 abuts the retaining surfaces 341 of the one-way ratchet 340 to block rotation. In the winding state, the first locking block 321 can be pushed along the arcuate guide surfaces 342 to drive rotation of the one-way ratchet 340. A shaft rod 315 is fixedly provided at one end of the retaining side plates 311 on the left and right sides of the retaining support 310. As shown in FIG. 1, the one end of the tightening strap 200 is sleeved over and fixed to the shaft rod 315.

Figure 4:
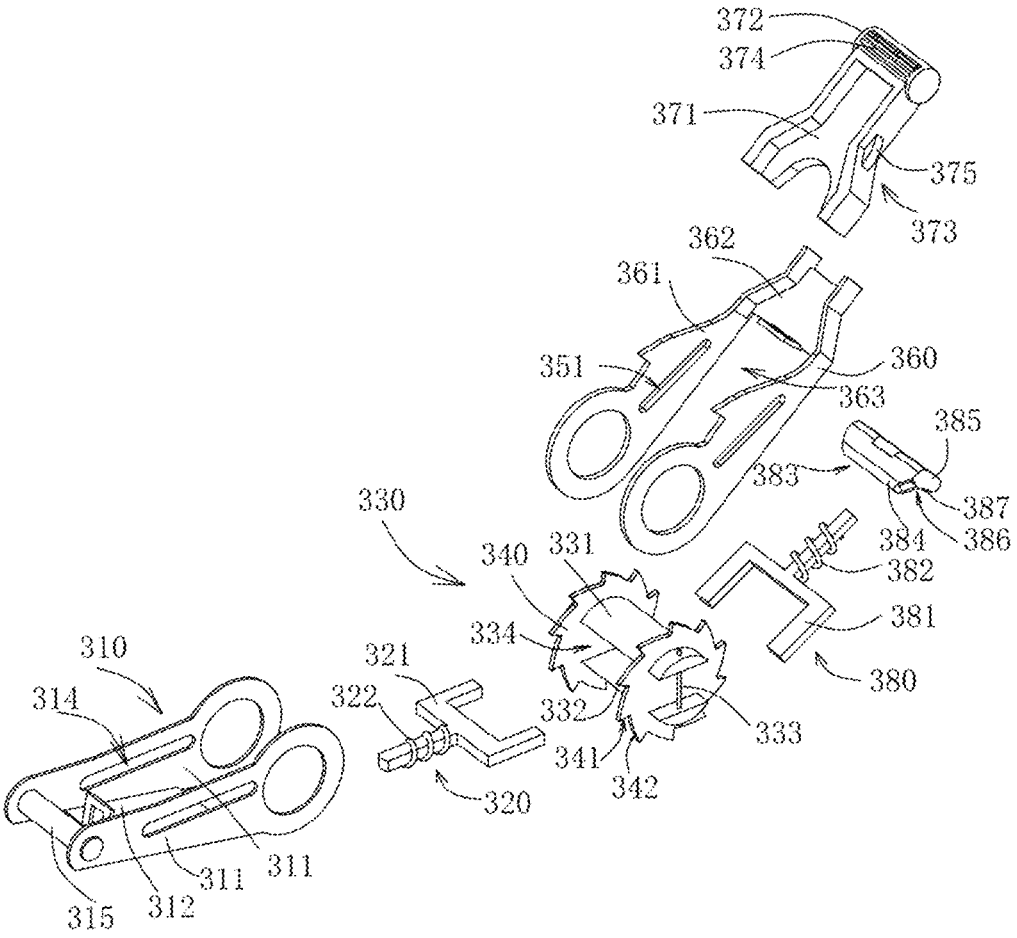
FIG. 4 is an exploded view of the tightening device of the swimming pool cover provided in an embodiment of the present application.

As shown in FIG. 2, FIG. 3, and FIG. 4, the winding shaft portion 330 in the present embodiment includes a first arcuate shaft 331 and a second arcuate shaft 332. The first arcuate shaft 331 and the second arcuate shaft 332 are both arranged on the one-way ratchet 340. The one-way ratchet 340 has an upper arcuate hole and a lower arcuate hole. The first arcuate shaft 331 and the second arcuate shaft 332 are respectively inserted into the upper arcuate hole and the lower arcuate hole, allowing the first arcuate shaft 331, the second arcuate shaft 332, and the one-way ratchet 340 to rotate together. The first arcuate shaft 331 and the second arcuate shaft 332 are symmetrically arranged about an axis of rotation (the central axis of the winding shaft portion 330). The retaining support 310 and the tensioning support 350 are both rotatably sleeved on the first arcuate shaft 331 and the second arcuate shaft 332. Two one-way ratchets 340 are respectively arranged on the left and right sides of the retaining side plates 311. The first arcuate shaft 331 and the second arcuate shaft 332 penetrate through the retaining side plates 311 on the left and right sides of the retaining support 310. Locking portions 333, such as pins or split pins, are arranged at both ends of the first arcuate shaft 331 and the second arcuate shaft 332 in the left-right direction. The locking portions 333 limit positions of the one-way ratchets 340, the retaining support 310, and the tensioning support 350, thereby achieving a stable connection. Between the retaining side plates 311 on the left and right sides of the retaining support 310, a threading cavity 334 is formed between the first arcuate shaft 331 and the second arcuate shaft 332. The threading cavity 334 or threading and fixing the other end of the tightening strap 200, facilitating fixation of the other end of the tightening strap 200 on the winding shaft portion 330.

As shown in FIG. 2, FIG. 3, and FIG. 4, the tensioning support 350 in the present embodiment includes a tensioning bracket 360 and a rubber-coated handle 370. The tensioning bracket 360 is rotatably arranged on the winding shaft portion 330. The tensioning bracket 360 includes tensioning side plates 361 and a second support plate 362, the tensioning side plates 361 is located on the left and right sides of the tensioning bracket 360. The second support plate 362 connects the two tensioning side plates 361, and is located at an outer edge of the tensioning side plates 361. The rubber-coated handle 370 is fixed to one end of the tensioning bracket 360 away from the winding shaft portion 330. The rubber-coated handle 370 includes a gripping position for palm during back-and-forth movement of the tensioning support 350, facilitating application of force to the tensioning bracket 360. A first distance is defined from a distal end of the rubber-coated handle 370 to the central axis of the winding shaft portion 330, and a second distance is defined from a center of the shaft rod 315 to the central axis of the winding shaft portion 330. The first distance is greater than the second distance, resulting in more effortless operation when pushing the tensioning support 350.

As shown in FIG. 2, FIG. 3, and FIG. 4, the rubber-coated handle 370 in the present embodiment includes a sleeve portion 371 and a cylindrical top portion 372. The sleeve portion 371 covers a top of the tensioning bracket 360. For example, the sleeve portion 371 can wrap around and be fixed on distal ends of the tensioning side plates 361 and a distal end of the second support plate 362, thereby more stably fixing the rubber-coated handle 370 to the tensioning support 350. The cylindrical top portion 372 is arranged a top of the sleeve portion 371. An outer diameter of the cylindrical top portion 372 is greater than a thickness of the sleeve portion 371. During use, the palm grips the cylindrical top portion 372, whose curved shape matches a contour of the palm, making the application of push and pull forces more convenient.

As shown in FIG. 2, FIG. 3, and FIG. 4, the sleeve portion 371 in the present embodiment forms obtuse angle openings 373 on left and right sides of the sleeve portion 371. Reinforcing ribs 375 are fixedly arranged inside the obtuse angle openings 373. The reinforcing ribs 375 is provided on the left and right sides of the sleeve portion 371, enhancing an overall structure integrity of the sleeve portion 371, increasing load-bearing capacity of the sleeve portion 371, and a connection with the tensioning bracket 360 is more stable. A second convex-concave anti-slip portion 374 is arranged on an outer surface of the cylindrical top portion 372. The second convex-concave anti-slip portion 374 increases friction of the cylindrical top portion 372, preventing slippage when the hand grips and applies pushing force, thereby improving operational convenience.

As shown in FIG. 2, FIG. 3, and FIG. 4, the second elastic limiting member 380 in the present embodiment includes a second locking block 381, a second spring 382, and a rubber-coated grip 383. The second locking block 381 is slidably arranged within second guide slots 351 of the tensioning bracket 360. The second spring 382 connects the second locking block 381 and the tensioning bracket 360. The second spring 382 applies an elastic force to the second locking block 381, causing the second locking block 381 to abut against the ratchet teeth of the one-way ratchet 340, thereby achieving function of cooperating with the locking teeth of the one-way ratchet 340. The rubber-coated grip 383 is provided on the second locking block 381. A handle portion 386 is formed on the rubber-coated grip 383, facing an outer side of the tensioning bracket 360. When it is necessary to release the winding shaft portion 330 to unwind the tightening strap 200, lifting the rubber-coated handle 370 in a direction away from the winding shaft portion 330 drives the second locking block 381 to disengage from the ratchet teeth of the one-way ratchet 340, thereby achieving loosening the winding shaft portion 330. The handle portion 386 provides a force point for fingers to hook onto the rubber-coated grip 383, facilitating operation.

As shown in FIG. 2, FIG. 3, and FIG. 4, the second support plate 362 is positioned near a top of the tensioning side plate 361, forming a cavity 363 on one side facing the winding shaft portion 330. The rubber-coated grip 383 is arranged within the cavity 363. The rubber-coated grip 383 in the present embodiment includes a rubber coating layer 384 and a protruding rubber block 385. The rubber coating layer 384 covers the second locking block 381, thereby securing the rubber-coated grip 383 to the second elastic limiting member 380. The protruding rubber block 385 is connected to a top of the rubber coating layer 384, forming the stepped handle portion 386 with the rubber coating layer 384. A cushioning layer 387 is provided on a surface of the handle portion 386. The cushioning layer 387 increases a thickness of the protruding rubber block 385, enhancing structural strength and making the entire rubber-coated grip 383 less prone to breakage. The cushioning layer 387 also facilitates the fingers hooking onto the protruding rubber block 385. A first convex-concave anti-slip portion 388 is provided on the surface of the handle portion 386 or the cushioning layer 387, increasing friction between the fingers and the protruding rubber block 385, preventing slippage during upward force application and making operation more convenient.

Figure 5:
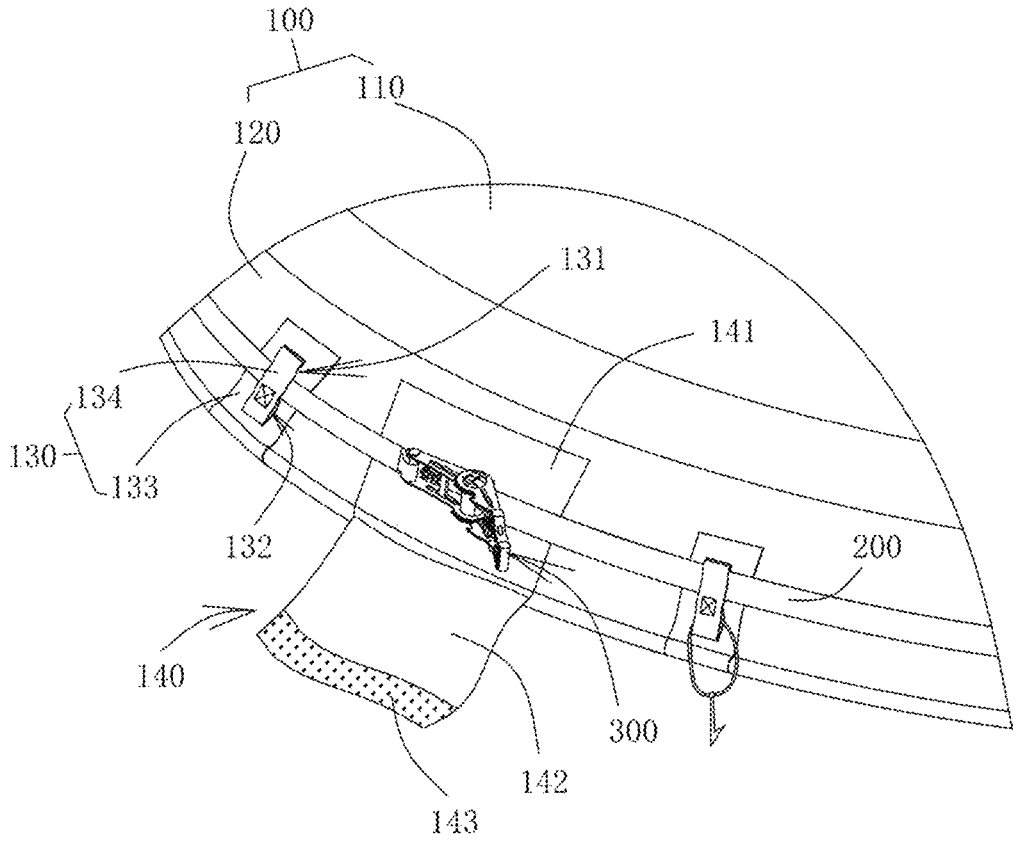
FIG. 5 a partial structural schematic diagram of the swimming pool cover provided in an embodiment of the present application.

As shown in FIG. 1 and FIG. 5, the lug 130 in the present embodiment further includes a mounting opening 132. The mounting opening 132 can be connected to a counterweight or a ground stake to further tighten the peripheral portion 120 of the pool cover, preventing the pool cover from being lifted or displaced. Both the mounting opening 132 and the rope passage 131 are provided on the lug 130, and the mounting opening 132 is located below the rope passage 131. For example, the lug 130 includes a bottom belt 133 and an outer belt 134 sewn onto the bottom belt 133. An upper end of the outer belt 134 is stitched to the bottom belt 133, and a middle portion of the outer belt 134 is also stitched to the bottom belt 133, forming the rope passage 131 at an upper part. A lower end of the outer belt 134 is bent and stitched to the middle portion of the outer belt 134, forming the lower mounting opening 132. The bottom belt 133 is stitched to the peripheral portion 120, thereby forming the lug 130.

As shown in FIG. 1 and FIG. 5, a covering shroud 140 is also provided on the peripheral portion 120. The covering shroud 140 can be attached to the peripheral portion 120 through a hook-and-loop fastener 143 and the covering shroud 140 serves to cover the tightening device 300. A bottom layer 141 of the covering shroud 140 is stitched to the peripheral portion 120 at a position where the tightening device 300 is located. A surface layer 142 of the covering shroud 140 can be folded over and connected to the bottom layer 141 via the hook-and-loop fastener 143. The upper end or multiple sides (upper, left, and right) of the surface layer 142 are provided with the hook-and-loop fastener 143. By folding the surface layer 142 of the covering shroud 140, the surface layer 142 can be attached to the peripheral portion 120 to achieve connection and fully cover the tightening device 300, thereby achieving connection and enclosing the tightening device 300 to conceal the tightening device 300.

The foregoing is only some embodiments of the present application and is not intended to limit the present application. Any modifications, equivalent substitutions, and improvements made within the spirit and principles of the present application shall fall within the scope of protection of the present application.

What is claimed is:

1. A swimming pool cover, comprising:

a flexible covering layer, wherein the flexible covering layer is configured to enclose and cover a swimming pool;

a tightening strap, wherein the tightening strap is disposed around the flexible covering layer;

a tensioning device, wherein the tensioning device comprises:

a retaining support and a tensioning support pivotally connected to each other, wherein a first elastic limiting member is disposed on the retaining support, and a second elastic limiting member is disposed on the tensioning support;

a winding shaft portion, wherein the winding shaft portion extends through a pivot connection between the retaining support and the tensioning support; and a one-way ratchet, wherein the one-way ratchet is disposed on the winding shaft portion, and the tightening strap is wound around the winding shaft portion;

wherein the tensioning support comprises:

a tensioning bracket, wherein the tensioning bracket is rotatably disposed on the winding shaft portion; and a rubber-coated handle, wherein the rubber-coated handle is fixedly disposed on the tensioning bracket at one end distal from the winding shaft;

wherein the rubber-coated handle comprises:

a sleeve portion, wherein the sleeve portion is sleeved over a top of the tensioning bracket; and a cylindrical top portion, wherein the cylindrical top portion is disposed at a top of the sleeve portion, and an outer diameter of the cylindrical top portion is greater than a thickness of the sleeve portion;

wherein two obtuse angle openings are formed on opposite sides in a width direction of the sleeve portion, and reinforcing ribs are fixedly disposed within the obtuse angle openings; and a second convex-concave anti-slip portion is disposed on an outer surface of the cylindrical top portion;

wherein the winding shaft portion has a locked state and a winding state by rotating the tensioning support;

wherein, in the locked state, the tensioning support is pulled to rotate toward the retaining support, the second elastic limiting member disengages from the one-way ratchet, and the one-way ratchet is locked by the first elastic limiting member to prevent rotation of the winding shaft portion;

wherein, in the winding state, the tensioning support is pulled to rotate away from the retaining support, the first elastic limiting member disengages from the one-way ratchet, and the one-way ratchet is locked by the second elastic limiting member and rotates with the tensioning support, causing the winding shaft portion to rotate; and wherein the tightening strap is wound by the rotation of the winding shaft portion to tighten the flexible covering layer around an outer side wall of the pool.

2. The swimming pool cover according to claim 1, wherein:

one end of the tightening strap is fixed to the retaining support, and another end of the tightening strap is wound around the winding shaft portion;

the tightening strap is disposed over the flexible covering layer and extends circumferentially around the outer side wall of the pool; and the winding shaft portion is driven by a reciprocating swing of the tensioning support to rotate unidirectionally, thereby winding up the tightening strap.

3. The swimming pool cover according to claim 2, wherein:

the winding shaft portion comprises: a first arcuate shaft and a second arcuate shaft;

the first arcuate shaft and the second arcuate shaft are both disposed on the one-way ratchet;

the retaining support and the tensioning support are rotatably sleeved on the first arcuate shaft and the second arcuate shaft; and the first arcuate shaft and the second arcuate shaft are spaced apart to form a threading cavity between the first arcuate shaft and the second arcuate shaft.

4. The swimming pool cover according to claim 1, wherein the second elastic limiting member comprises:

a second locking block, wherein the second locking block is slidably disposed within second guide slots of the tensioning bracket;

a second spring, wherein the second spring is connected respectively to the second locking block and the tensioning bracket, and applies elastic force to the second locking block, causing the second locking block to engage with teeth of the one-way ratchet; and a rubber-coated grip, wherein the rubber-coated grip is disposed on the second locking block, and wherein the rubber-coated grip forms a handle portion, with the handle portion facing outward an outer side of the tensioning bracket.

5. The swimming pool cover according to claim 4, wherein the rubber-coated handle comprises:

a rubber coating layer, wherein the rubber coating layer encases the second locking block;

a protruding rubber block, wherein the protruding rubber block is connected to a top of the rubber coating layer, with the handle portion having a step shape being formed between the protruding rubber block and the rubber coating layer;

a cushioning layer, wherein the cushioning layer is disposed on a surface of the handle portion; and a first convex-concave anti-slip portion is disposed on the surface of the handle portion or on a surface of the cushioning layer.

6. The swimming pool cover according to claim 4, wherein the tensioning support comprises:

tensioning side plates located on two widthwise sides of the tensioning support; and a second support plate connecting the tensioning side plates;

wherein the second support plate is disposed adjacent to tops of the tensioning side plates, forming a cavity on a side of the second support plate facing the winding shaft portion; and wherein the rubber-coated handle is positioned within the cavity.

7. The swimming pool cover according to claim 1, wherein the retaining support comprises:

retaining side plates located on two widthwise sides of the retaining support; and a first support plate connecting the retaining side plates;

wherein the retaining side plates and the first support plate form a first inner cavity, and the first elastic limiting member is disposed within the first inner cavity; and wherein a shaft rod is fixedly disposed at one end of the retaining side plates, and the one end of the tightening strap is connected to the shaft rod.

8. The swimming pool cover according to claim 1, wherein:

the flexible covering layer comprises a central portion and a peripheral portion, the peripheral portion is connected to the central portion, the central portion is configured to cover a pool opening, and the peripheral portion is configured to enclose the outer side wall of the pool;

a lug is disposed on the peripheral portion, the lug forms a rope passage, and the tightening strap passes through the rope passage;

the lug further forms a mounting opening, the mounting opening is located below the rope passage, and the mounting opening is configured for connection to a weight or a ground stake; and a cover shroud is further disposed on the peripheral portion, the cover shroud is attached to the peripheral portion via a hook-and-loop fastener, and the cover shroud is configured to cover the tensioning device.

9. A swimming pool cover, comprising:

a flexible covering layer configured to enclose and cover a swimming pool;

a tightening strap disposed around the flexible covering layer;

a tensioning device, comprising:

a retaining support and a tensioning support pivotally connected to each other, wherein a first elastic limiting member is disposed on the retaining support, and a second elastic limiting member is disposed on the tensioning support;

a winding shaft portion extending through a pivot connection between the retaining support and the tensioning support; and a one-way ratchet disposed on the winding shaft portion, wherein the tightening strap is wound around the winding shaft portion;

wherein the tensioning support comprises:

a tensioning bracket rotatably disposed on the winding shaft portion; and a rubber-coated handle fixedly disposed on the tensioning bracket at one end distal from the winding shaft;

wherein the second elastic limiting member comprises:

a second locking block slidably disposed within second guide slots of the tensioning bracket;

a second spring connected respectively to the second locking block and the tensioning bracket, wherein the second spring applies elastic force to the second locking block, causing the second locking block to engage with teeth of the one-way ratchet; and a rubber-coated grip disposed on the second locking block, wherein the rubber-coated grip forms a handle portion facing outward an outer side of the tensioning bracket;

wherein the rubber-coated handle comprises:

a rubber coating layer encasing the second locking block;

a protruding rubber block connected to a top of the rubber coating layer, with the handle portion having a step shape being formed between the protruding rubber block and the rubber coating layer;

a cushioning layer disposed on a surface of the handle portion; and a first convex-concave anti-slip portion disposed on the surface of the handle portion or on a surface of the cushioning layer;

wherein the winding shaft portion has a locked state and a winding state by rotating the tensioning support;

wherein, in the locked state, the tensioning support is pulled to rotate toward the retaining support, the second elastic limiting member disengages from the one-way ratchet, and the one-way ratchet is locked by the first elastic limiting member to prevent rotation of the winding shaft portion;

wherein, in the winding state, the tensioning support is pulled to rotate away from the retaining support, the first elastic limiting member disengages from the one-way ratchet, and the one-way ratchet is locked by the second elastic limiting member and rotates with the tensioning support, causing the winding shaft portion to rotate; and wherein the tightening strap is wound by the rotation of the winding shaft portion to tighten the flexible covering layer around an outer side wall of the pool.

10. A swimming pool cover, comprising:

a flexible covering layer configured to enclose and cover a swimming pool, and comprising a central portion and a peripheral portion, wherein the peripheral portion is connected to the central portion, the central portion is configured to cover a pool opening, and the peripheral portion is configured to enclose the outer side wall of the pool;

a tightening strap disposed around the flexible covering layer; and a tensioning device, comprising:

a retaining support and a tensioning support pivotally connected to each other, wherein a first elastic limiting member is disposed on the retaining support, and a second elastic limiting member is disposed on the tensioning support;

a winding shaft portion extending through a pivot connection between the retaining support and the tensioning support; and a one-way ratchet disposed on the winding shaft portion, wherein the tightening strap is wound around the winding shaft portion;

wherein a lug is disposed on the peripheral portion, the lug forms a rope passage, and the tightening strap passes through the rope passage;

wherein the lug further forms a mounting opening located below the rope passage, the mounting opening being configured for connection to a weight or a ground stake;

wherein a cover shroud is further disposed on the peripheral portion, the cover shroud being attached to the peripheral portion via a hook-and-loop fastener and configured to cover the tensioning device;

wherein the winding shaft portion has a locked state and a winding state by rotating the tensioning support;

wherein, in the locked state, the tensioning support is pulled to rotate toward the retaining support, the second elastic limiting member disengages from the one-way ratchet, and the one-way ratchet is locked by the first elastic limiting member to prevent rotation of the winding shaft portion;

wherein, in the winding state, the tensioning support is pulled to rotate away from the retaining support, the first elastic limiting member disengages from the one-way ratchet, and the one-way ratchet is locked by the second elastic limiting member and rotates with the tensioning support, causing the winding shaft portion to rotate; and wherein the tightening strap is wound by the rotation of the winding shaft portion to tighten the flexible covering layer around an outer side wall of the pool.

* * * * *